US006046690A

United States Patent [19]

Evans, III

[11] Patent Number: 6,046,690

[45] Date of Patent: Apr. 4, 2000

[54] METHOD AND SYSTEM FOR COMMUNICATING AT A STADIUM EVENT BY ALTERING THE WAVE

[76] Inventor: David Evans, III, 16 E. Oakwood Hills Dr., Chandler, Ariz. 85248

[21] Appl. No.: 09/287,407

[22] Filed: Apr. 6, 1999

[51] Int. Cl.[7] ..... G08G 1/123

[52] U.S. Cl. ..... 340/999; 340/815.4; 340/540

[58] Field of Search ..... 340/999, 540, 340/815.4, 815.62, 815.65, 815.71

[56] References Cited

U.S. PATENT DOCUMENTS 5,435,010 7/1995 May ..... 2/67

5,515,542 5/1996 Simmons ..... 2/67

5,756,166 5/1998 Shinohara ..... 428/24

5,947,943 9/1999 Lee ..... 604/361

*Primary Examiner*—Daniel J. Wu

*Assistant Examiner*—Anh La

*Attorney, Agent, or Firm*—Tod R. Nissle, P.C.

[57] ABSTRACT

A method and system for communicating at an event produces a selected visual image related to the event by altering the wavelength of electromagnetic waves emanating from articles carried by a designated group of spectators at the event.

2 Claims, 2 Drawing Sheets

METHOD AND SYSTEM FOR COMMUNICATING AT A STADIUM EVENT BY ALTERING THE WAVE

Figure 1:
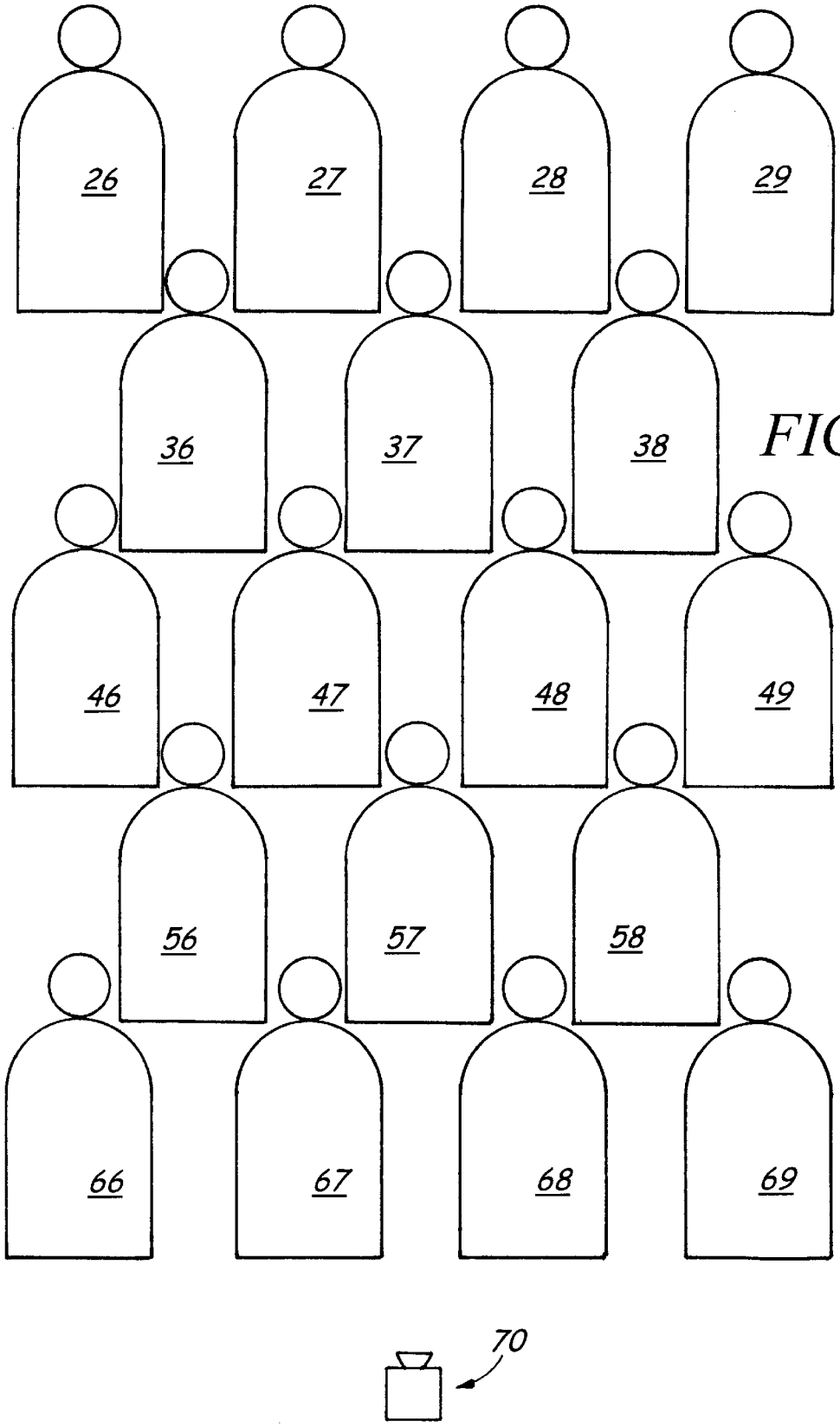

This invention relates to a method and system of communication.

More particularly, the invention relates to a method and system of visual communication by a group at an event in a stadium.

In a further respect, the invention relates to a method and system for communicating at an event by producing a selected visual image related to the event by altering the wavelength of electromagnetic waves emanating from articles carried by a group of spectators at the event.

Conferences, sporting events, and other events involving large groups of people are often conducted in stadiums. The stadium can be an indoor arena, an outdoor (uncovered) arena, or can be any other area where a group of people gather to witness and/or participate in an event. During such events it is often desirable to promote interaction and communication between the spectators or attendees and the performers at the event. Such interaction can make an event more enjoyable and productive.

One way interaction and communication between attendees and performers are achieved is to have an attendees actually join the performers on stage for a period of time.

Another way interaction and communication between attendees and performers are achieved is to have attendees ask questions of the performers.

A further way interaction and communication between attendees and performers are achieved is to have the attendees applaud or cheer for the performers.

Still another way interaction and communication between attendees and performers are achieved is to have the performers presents gifts to some of the attendees.

Yet a further way interaction and communication are achieved is to have some attendees take part in a contest during an intermission in the performance.

Yet still a further way interaction and communication are achieved is to have attendees take an examination at some point during the event. This is especially the case when the event is an educational event.

Each of the foregoing methods of promoting attendee-performer interaction and communication has merit and has long been practiced. Since however, the number of attendees typically is much greater than the number of performers, many of the methods listed above can only, practically speaking, be accomplished with a limited number of attendees. Further, each of the foregoing methods requires active participation by an attendee. Many attendees are reluctant to actively participate.

Accordingly it would be desirable to provide an improved system and method of promoting attendee-performer interaction and communication which could readily include all or the majority of attendees and which would require little or no active participation by an attendee.

It would also be desirable to provide an improved system and method of promoting attendee-performer interaction and communication which surprises an attendee by allowing her or him to participate unexpectedly in attendee-performer interaction.

Therefore, it is a principal object of the invention to provide an improved method and system to facilitate performer-attendee interaction and communication at an event.

Another object of the invention is to provide an improved method and system which promotes attendee-performer interaction and communication at an event by readily allowing all or most attendees to participate and by requiring only passive participation (i.e., by requiring little if any active participation by the attendees).

A further object of the invention is to provide an improved method and system for attendee-performer interaction, which system utilizes remote airborne physical phenomena to interact with an attendee.

Still another object of the invention is to provide an improved method and system for attendee-performer interaction which changes the appearance of the attendee without requiring active participation by the attendee during the performance.

Figure 2:
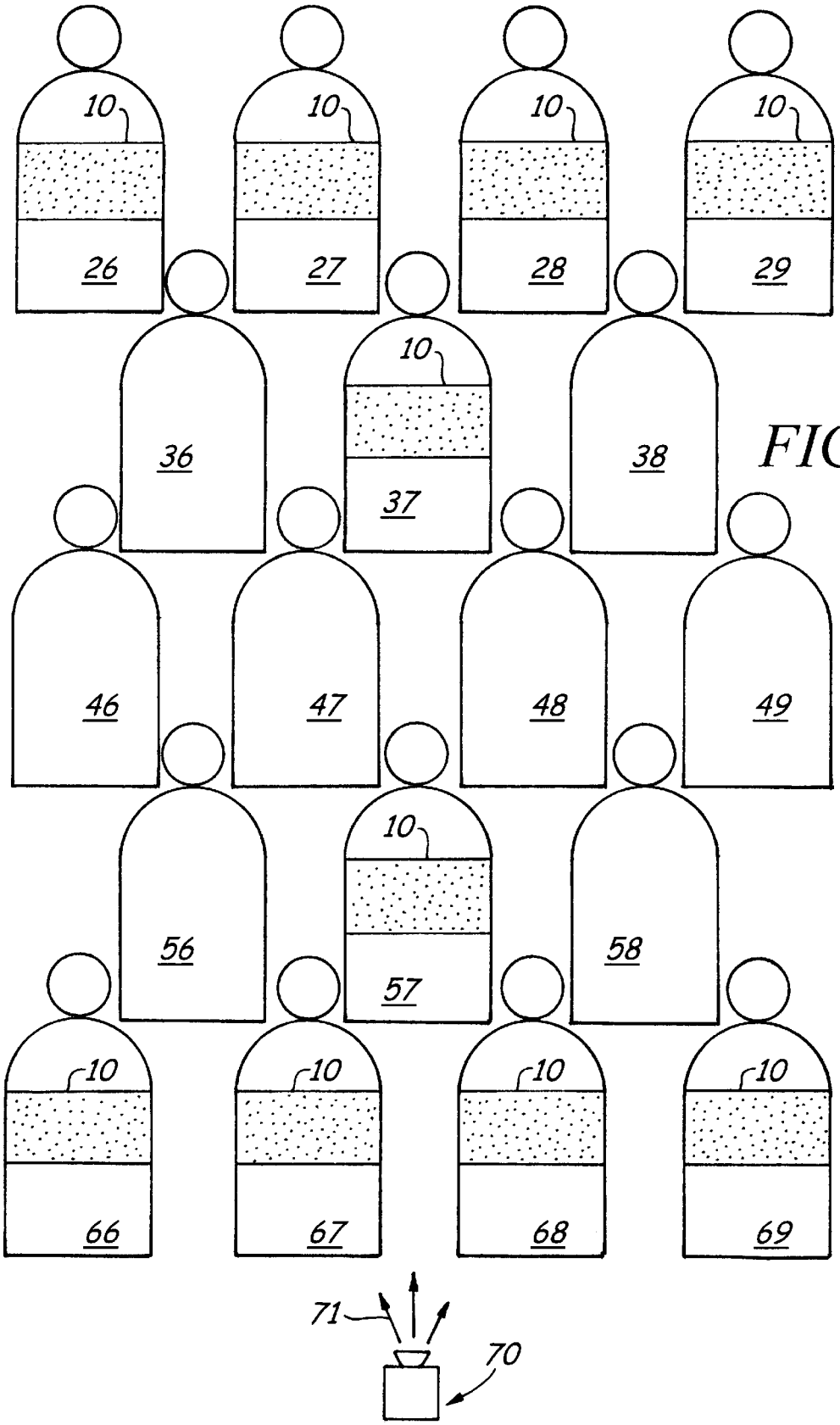

These and other further and more specific objects and advantages of the invention will be apparent to those skilled in the art from the following detailed description thereof, take in conjunction with the drawings, in which:

FIG. 1 is a front view illustrating a group of individuals attending an event in a stadium and each having an external article carried on the person and emanating electromagnetic waves which to the eye of a person viewing the group produce the color white; and, FIG. 2 is a front view illustrating the group of individuals of FIG. 1 subsequent to the use of an external airborne physical component to alter the wavelength of electromagnetic waves emanating from the external article such that the electromagnetic waves produce to the eye of a person viewing the group a color which is different than and can be readily visually distinguished from the color white.

Briefly, in accordance with my invention, I provide an improved system for communicating at an event in a stadium. The system includes a plurality of articles each to be carried on the person and having electromagnetic waves of at least one visible wavelength emanating from the article; a system for providing at least some of the individuals attending the event with at least one of the articles; a system for directing each individual with one of the articles to a selected staging area in the stadium to form a selected grouping such that the articles, electromagnetic waves emanating from the articles, and the grouping are visible to others in the stadium; and, a system external of each individual for, when the individuals with the articles are in the selected grouping in the selected area in the stadium, altering airborne physical components contacting the articles such that the wavelength of electromagnetic waves emanating from each of the articles is changed to a selected different visible electromagnetic wavelength, and to produce, for others in the stadium viewing the grouping, at least one selected visual image related to the event and including the different visible electromagnetic wavelength from each article.

In another embodiment of the invention I provide an improved method for communicating at an event in a stadium. The method includes the steps of providing a plurality of articles each to be carried on the person and having electromagnetic waves of at least one visible wavelength emanating from the article; providing at least some of the individuals attending the event with at least one of the articles; directing each individual with one of the articles to a selected staging area in the stadium to form a selected grouping such that the articles, electromagnetic waves emanating from the articles, and the grouping are visible to others in the stadium; and, when the individuals with the articles are in the selected grouping in the selected area in the stadium, altering airborne physical components contacting the articles such that the wavelength of electromagnetic waves emanating from each of the articles is changed to a selected different visible electromagnetic wavelength, and to produce, for others in the stadium viewing the grouping, at least one selected visual image related to the event and including the different visible electromagnetic wavelength from each article.

Turning now to the drawings, which depict the presently preferred embodiments of the invention for purposes of illustrating the invention and not by way of limitation of the scope of the invention, FIG. 1 illustrates a group of individuals attending and viewing an event in a stadium and each having an external article carried on the person and emanating electromagnetic waves which to the eye of a person viewing the group produce the color white. Each individual 26 to 29, 36 to 38, 46 to 49, 56 to 58, and 66 to 69 is seated in a designated seat or is standing in another selected staging area in the stadium. As is well known, the seating in most modern day stadiums is identified by sections, and each section has numbered seats. For sake of this example, and not by way of limitation, the reference character assigned each individual in FIGS. 1 and 2 corresponds to the seat which the individual occupies. Consequently, individual 26 is in seat number twenty-six, individual 27 is in seat number twenty-seven, individual 28 is in seat number twenty-eight, individual 29 is in seat number twenty-nine, individual 30 is in seat number thirty, etc., and, the individuals in FIGS. 1 and 2 are therefore occupying seats numbered from twenty-six to twenty-nine, from thirty-six to thirty-eight, from forty-six to forty-nine, from fifty-six to fifty-eight, and from sixty-six to sixty-nine. Seats twenty-six to twenty-nine comprise a first row; seats thirty-six to thirty-eight comprise a second row; seats forty-six to forty-nine comprise a third row; seats fifty-six to fifty-eight comprise a fourth row; and, seats sixty-six to sixty-nine comprise a fifth row. The first, second, third, fourth and fifth rows are each parallel to the other remaining rows. E.g., the first row is parallel to the second, third, fourth and fifth rows. The number of individuals in a selected group can vary as desired.

The article carried by each individual is provided at a desired time and location. The article can be provided to the individual as he or she enters the stadium. The article can be provided to the individual at a location remote from the stadium, or, the article can be provided by having the individual pick up or purchase the article at a time and place the individual selects.

Unit 70 is spaced apart from each of the individuals in the group depicted in FIG. 1. As will be described, a physical component 71 produced or provided by unit 70 is utilized to alter the wavelength of electromagnetic waves emanating from a selected area on an article carried by one or more of the individuals in the group of FIG. 1. Each individual can carry an article which is identical to the article carried by the other individuals, or, each individual can carry an article which is different from the article carried by one or more of the other members of the selected group of individuals depicted in FIG. 1. The article carried by each individual 26 to 29, 36 to 38, 46 to 49, 56 to 58, 66 to 69 ordinarily preferably is visible to another individual who can see the front of each individual 26 to 29, 36 to 38, etc. who is carrying the article; however, in some instance the article can be hidden beneath the clothing of each individual 26 to 29, 36 to 38, etc. as long as the article—when used in the manner described with respect to FIG. 2—produces electromagnetic waves which can be viewed by others in the stadium. By way of example, and not limitation, the article carried by each individual 26 to 29, etc. can comprise a rectangular cardboard panel, a circular panel, or an article of clothing. For purposes of the presently preferred embodiments of the inventions, it is preferred, but not required, that the article cover the majority of the front of the upper body area (i.e., chest and stomach) of an individual. The wavelength of electromagnetic waves produced by the article under the illumination of a particular light source like the lighting in a stadium or sunlight can vary as desired. But for sake of this example, it is assumed that when the group of FIG. 1 is in the stadium, the fluorescent or other light fixtures normally used to illuminate the interior of the stadium for attendees and/or for the event performers produce light which, when it contacts the articles, causes electromagnetic waves to emanate from the articles such that the articles appear to a person viewing the articles to be white.

The group in FIG. 1 is visible to other individuals (not shown) who are also in the stadium to attend and watch the event.

While in some embodiments of the invention, the individuals attending the event in the stadium can be permitted to select their own seats, it is more likely that each individual will have a designated seat in a selected staging area or section of the stadium seating. Accordingly, each individual 26 to 29, 36 to 38, etc. in FIG. 1 has a specific seat designated on his or her ticket, designated as they enter the stadium, or designated by some other means. Further, individuals 26 to 29, 37, 57, and 66 to 69 each have one kind of article while individuals 36, 38, 46 to 49, 56, and 58 have another kind of article.

Chemical compositions which, when the humidity increases, experience a change in the wavelength of electromagnetic waves emanating from the chemical composition are well known. Many children's chemistry sets includes an experiment where a water sensitive chemical composition is applied to a piece of white paper. When viewed in sunlight the wavelength of electromagnetic waves emanating from chemical composition and paper make them appear white. When the humidity rises, the water sensitive chemical composition absorbs moisture from the air and causes the wavelength of electromagnetic waves emanating from the water sensitive chemical composition to change such that the chemical composition appears blue or pink to a viewer, and not white. In FIG. 1, the articles supplied to individuals 26 to 29, 37, 57, 66 to 69 include a water sensitive chemical composition applied to a rectangular area on the outer surface of the article. In contrast, the articles supplied to individuals 36, 38, 46 to 49, 56, and 58 do not include this chemical composition. When the individuals 26 to 29, 37, 57, 66 to 69 enter the stadium, the humidity is low and their articles, along with the articles carried by individuals 36, 38, 46 to 49, 56, 58, each produce when illuminated by stadium lighting electromagnetic waves which emanate from the article and make the article appear to have an "initial" white color to those viewing the article. At a selected time, unit 70 is activated to dispense 71 an airborne physical component consisting of water mist into the air in the stadium to raise the humidity in the stadium. Since the mist increases the humidity of air in the stadium, the mist functions to alter an airborne physical component, i.e., functions to alter the water content of the air. Once the humidity reaches a selected level, the water sensitive chemical composition on the articles worn by individuals 26 to 29, 37, 57, 66 to 69 absorbs sufficient moisture to cause the wavelength of electromagnetic waves emanating from the chemical composition to change such that the rectangular areas 10 no long appear white to viewers but appear to have a "secondary" blue or pink color. Unit 70 can also be utilized to cause the "secondary" color to disappear and the "initial"

color to reappear simply by (1) turning off unit 70 to discontinue the production of water mist, and (2) by utilizing a "dehumidifier" portion in unit 70 to remove moisture from the air to reduce the humidity of the air.

Chemical compositions affected by heat are also known in the art. Some "invisible" inks can not be seen at room temperature on a piece of paper until the inks are heated. Such inks can, for example, be made from milk, whey, sugar solutions, or any colorless vegetable juice. Instead of applying a water sensitive chemical composition to articles carried on the individuals, a heat sensitive chemical composition can be utilized. In this scenario, the airborne physical component dispensed by unit 70 is heat. Since the heat increases the temperature of the air, the heat functions to alter an airborne physical component, i.e., functions to alter the heat content of the air. The heat sensitive chemical composition can, in place of or in conjunction with the earlier mentioned water sensitive chemical composition, be applied to a rectangular (or other shaped area) area 10 on the outer surface of the article carried by individuals 26 to 29, 37, 57, 66 to 69. When heat 71 dispensed by unit 70 causes the ambient air temperature to reach a high enough temperature, the wavelength of electromagnetic waves emanating from the heat sensitive chemical composition in areas 10 changes, such that the areas 10 no long appear to have the "initial" white color (or some other initial color) to viewers but appear to be a different "secondary" color. Unit 70 can also be utilized to cause the secondary color to disappear and the initial color to reappear simply by (1) turning off unit 70 to discontinue the production of heat, and/or (2) utilizing an "air cooling" portion in unit 70 to produce cool air.

Chemical compositions which are sensitive to particular wavelengths of electromagnetic radiation are also known. A chemical composition sensitive to a particular wavelength of electromagnetic radiation is applied to area 10. The chemical composition is, for example, sensitive to electromagnetic waves having a wavelength of about three hundred nm (3000 angstrom units). In this scenario, the airborne physical component 71 dispensed by unit 70 comprises electromagnetic waves of a particular wavelength. Since the electromagnetic waves 71 dispensed by unit 70 are different than the electromagnetic waves emanating from fluorescent and other lights in the stadium, the electromagnetic waves 71 function to alter the composition of light (typically from fluorescent or other lights in the stadium) which travels through the air and contacts the chemical composition on or in the article, and, the electromagnetic waves 71 dispensed by unit 70 function to alter an airborne physical component, i.e., alter the makeup of light contacting the chemical composition. The electromagnetic wave-sensitive chemical composition can, in place of or in conjunction with the earlier mentioned moisture and heat sensitive chemical compositions, be applied to a rectangular (or other shaped area) area 10 on the outer surface of the article carried by individuals 26 to 29, 37, 57, 66 to 69. When electromagnetic waves 71 with a wavelength of about 300 nm are produced and emitted by unit 70, the wavelength of electromagnetic waves emanating from the electromagnetic wave-sensitive chemical in areas 10 changes, such that the areas 10 no long appear to have the "initial" white color (or some other color) to viewers but appear to take on a "secondary" color different than the primary white color. Unit 70 can also be utilized to cause the secondary color to disappear and the primary color to reappear simply by (1) turning off unit 70 to discontinue the production of 300 nm wavelength electromagnetic waves, or (2) by blocking or filtering out the 300 nm electromagnetic waves produced by unit 70. If an individual walks from outdoors in the sunlight into a stadium with a fixed roof which enclosed the stadium, then the stadium itself comprises the unit 70 which functions to alter airborne physical components contacting an article simply because the stadium blocks out the sunlight and because the makeup of the artificial light is different from the makeup sunlight. Or, in stadium having retracting roofs, the stadium roof can be closed to block out the sunlight and, consequently, comprise unit 70 which functions to alter an airborne physical component (i.e., to alter the wavelength of light contacting the article worn by an attendee in the stadium) which contacts the articles carried by attendees in the stadium.

Other examples of airborne physical components which can be altered in the practice of the invention include, without limitation, airborne particulate and airborne gases.

Chemical compositions utilized in the practice of the invention can vary as desired and can comprise the article in its entirety or can be applied to the surface of or integrated in an article carried into a stadium by an individual attending an event in the stadium. The article can comprise paper, plastic, metal, etc. which is coated, inset, doped, or otherwise treated with a desired chemical composition. The chemical composition elected permits a desired airborne physical component to, when the airborne physical component is altered, change the wavelength of electromagnetic waves emanating from the chemical composition. The wavelength is changed an amount sufficient for an individual viewing the chemical composition to detect the change in wavelength due to change in color or color hue of the chemical composition. One chemical composition can comprise an ink which changes color when contacted by ultraviolet radiation.

In FIG. 2, the airborne physical component 71 (whether moisture, heat, electromagnetic waves, etc.) from unit 70 has caused the chemical composition in or on the areas 10 on the articles carried by individuals 26 to 29, 37, 57, 66 to 69 to emanate electromagnetic waves having a wavelength which makes areas 10 appear to a viewer to have a secondary color different than the primary color white. White was the color of areas 10 before the airborne physical component 71 was produced by unit 70. The articles carried by individuals 36, 38, 46 to 49, 56, 58 do not change color because those articles do not include the chemical composition found on articles on individuals 26 to 29, 37, 57, 66 to 69. Since individuals 26 to 29, 37, 57, 66 to 69 collectively form a visual image corresponding to the letter "I", the areas 10 on the articles 26 to 29, 37, 57, 66 to 69 also collectively form an "I" when viewed against individuals 36, 38, 46 to 49, 56, 58 having articles which did not change color and which emanate wavelengths which make the articles on individuals 36, 38, 46 to 49, 56, 58 continue to appear white. If the event attended by the individuals in FIG. 2 consisted of a basketball game between Indiana University and another team, then the visual image (i.e., the "I") formed in FIG. 2 relates to the event because it stands for Indiana University. Other visual images which would be related to the event would be a basketball, a building or other recognizable landmark on the Indiana University campus, the Indiana University mascot, the mascot of the opposing team, the year the event is taking place, the number of a player on the Indiana team, etc. As utilized herein "related" means concerning or connected to. In stadiums which hold thousands of spectators, it is possible, by using groupings of many attendees or spectators, to make patterns which are like the "I" pattern in FIG. 2 but which are more complicated and intricate.

The following examples are given by way of explanation and not limitation of the invention.

EXAMPLE 1

Basketball teams from Duke and Ohio State University are playing for the national basketball championship in an indoor stadium on the Ohio State University campus which holds nineteen thousand spectators. The stadium is oval shaped, has a lower tier of seats, and has an upper tier of seats. Each tier of seats is divided into sections A, B, C, D, etc. The seats in each section are numbered. The first seat in each section is numbered 1, the second is numbered 2, etc. Section A is in the lower tier and is reserved and is a selected staging area for a grouping of spectators who support the Ohio State University basketball team. Red and white are the team colors for Ohio State.

In section A of the first tier, the first row of seats is numbered 1 to 20 from left to right (left is the left of a person facing the seats while standing on the basketball floor); the second row is numbered 21 to 40 from left to right; the third row 41 to 60 from left to right; the fourth row 61 to 80 from left to right; the fifth row 81 to 100 from left to right; the sixth row 101 to 120 from left to right; the seventh row 121 to 140 from left to right; the eighth row 141 to 160 from left to right; the ninth row 161 to 180 from left to right; the tenth row 181 to 200 from left to right. The first to tenth rows in section A are parallel to one another and are generally situated one behind the other in conventional fashion such that seats 1 to 200 in section A generally lie in and define a rectangular area. The rows in FIG. 1 are also generally situated one behind the other in conventional fashion.

Prior to the championship game, each spectator in section A is encouraged to acquire a two foot by two foot square piece of pliable laminate. The laminate consists of a piece of cloth covered by a coextensive piece of thin paper. Each laminate includes a piece of string attached at both ends to the laminate so that a spectator can place the string over his head and neck so that the string extends around the back of the spectator's neck and suspends the laminate over and against the chest and stomach of the spectator. The front outward facing surface of each laminate (i.e., the front surface of the thin piece of paper) is covered with an ink or other chemical composition from which emanates electromagnetic waves having a wavelength that makes the front outward facing surface of the laminate appear red to a viewer when the chemical composition is exposed to electromagnetic waves having a wavelength in the range of 300 to 350 nm. When exposed to other wavelengths of light, the electromagnetic waves emanating from the front outward facing surface of the laminate have a wavelength that makes the front of the laminate appear white in color to a viewer. Many of the spectators in section A buy the laminates at the Ohio State University bookstores. Some of the spectators in section A buy or are given the laminates at the Ohio State University basketball stadium on the afternoon of the game. When the spectators in section A are walking outside in the sunlight to the stadium, electromagnetic waves emanating from the front outward facing surface make the laminate appear red. After the spectators enter the stadium, electromagnetic waves emanating from the front outward facing surface of each laminate makes the laminate appear white because the light utilized to illuminate the interior of the stadium does not produce electromagnetic waves having a wavelength of 300 to 350 nm. Consequently, when each of the spectators sits in section A with the front outward facing surface of the laminate positioned over the chest and stomach of the spectator and facing out, electromagnetic waves emanating from the front outward facing surface of each laminate make the front outward facing surface appear white, and the entire section A appears substantially white to other spectators in the stadium who can view section A. The resultant "white colored" section A is a visual image related to the event and is encouraging to the Ohio State basketball players because white is one of the team colors. At a selected time during the game, equipment inside the stadium is turned on to produce electromagnetic waves having a wavelength in the range of 300 to 350 nm. When these 300 to 350 nm waves contact the front outward facing surface of each laminate, the front outward facing surface produces electromagnetic waves which emanate from the front surface and make the surface appear red to a viewer. The resultant "red colored" section A is a visual image related to the event and is also encouraging to the Ohio State basketball players.

EXAMPLE 2

Example 1 is repeated except that all of the laminates are distributed inside the stadium just prior to the game. Each attendee receives a laminate. Since the laminates are inside the stadium, the front surface of each laminate emanates electromagnetic waves having a wavelength which make the front outwardly facing surface appear white. The attendees are not aware that the appearance of the front outwardly facing surface of the laminates will change during the game. At a selected time during the game, equipment inside the stadium is turned on to produce electromagnetic waves having a wavelength in the range of 300 to 350 nm. When these 300 to 350 nm waves contact the front outwardly facing surface of each laminate, the front outwardly facing surface produces electromagnetic waves which emanate from the front outwardly facing surface and make the surface appear red to a viewer. Since each or most of the attendees are wearing a laminate, the stadium becomes a "sea of red". The resultant "sea of red" is a surprise to the attendees, is a visual image related to the event, and is encouraging to the Ohio State basketball players.

EXAMPLE 3

Example 2 is repeated except that each laminate is given to an attendee outside in the afternoon sunlight. Equipment inside the stadium is turned on to produce artificially in the stadium electromagnetic waves having a wavelength in the range of 300 to 350 nm. In the sunlight, the electromagnetic waves emanating from the front outwardly facing surface of each laminate makes the laminate appear red to a viewer. The 300 to 350 nm artificially produced electromagnetic waves inside the stadium also produce electromagnetic waves which emanate from the front outwardly surface of each laminate and make the laminate continue to appear red to a viewer. At a selected time during the game, the equipment inside the stadium is turned off so the equipment no longer produces electromagnetic waves having a wavelength in the range of 300 to 350 nm. When these 300 to 350 nm waves are no longer produced and no longer contact the front outwardly surface of each laminate, the front outwardly facing surface produces electromagnetic waves which emanate from the surface and make the surface appear white to a viewer. Since each or most of the attendees are wearing a laminate, the stadium changes from a "sea of red" to a "sea of white". The resultant "sea of white" is a surprise to the attendees, is a visual image related to the event, and is encouraging to the Ohio State basketball players.

Central to the invention is altering one or more airborne physical components to change the wavelength of electromagnetic waves emanating from a article worn by a plurality of attendees assembled in a stadium in a selected grouping in order to produce at least one visual image related to the event being attended. The change in the wavelength of electromagnetic waves emanating from an article must be visually discernible by a viewer. Changing the wavelength of electromagnetic waves emanating from an article from 5000 angstroms to 5001 angstroms does not meet the object of the invention because a human being of average discerning ability can not visually discern or detect such a minuscule change. The change in wavelength must be sufficient for an individual to visually detect the change as a change in color or color hue. The visual image is seen by and communicates with other attendees at the event. The airborne physical components which are altered contact the article worn by each participating attendee. The equipment for altering an airborne physical component is ordinarily, but not necessarily, spaced apart from the grouping of the attendees and from the articles carried by the attendees. The visual image can be a symbol like a letter of the alphabet (as in FIG. 2) or a numeral. The visual image can also be pictorial or take on any desired shape and dimension and color scheme. The selected grouping can comprise any desired arrangement of a plurality of people; however, the grouping typically comprises the attendees sitting in all or most of the seats in a particular designated portion or area of a stadium. Each article worn by an attendee can include more than one chemical composition so that multiple colors can be produced on the article.

In the practice of the invention, defining or recognizing the type of incident electromagnetic wave(s) striking an article is important. Sunlight typically includes wavelengths of electromagnetic waves which are not found in electromagnetic waves produced by fluorescent or incandescent bulbs. The intensity of each wavelength of electromagnetic wave found in sunlight can also be different than the intensity of the corresponding wavelength in electromagnetic waves produced by fluorescent or incandescent bulbs or another light source. A chemical composition can be visible in sunlight because it is contacted by a particular wavelength (for example, ultraviolet) of electromagnetic wave found in sunlight. This particular wavelength may not be found in electromagnetic waves from an artificial light source, in which case the chemical composition is not visible when contacted by electromagnetic waves from the artificial light source.

Electromagnetic waves emanating from an article can consist of reflected electromagnetic waves, of electromagnetic waves generated by electron movement in the article, and/or of electromagnetic waves otherwise generated by the article. Fluorescence is producing by electron movement.

Having described my invention in such terms as to enable those skilled in the art to understand and practice it, and having identified the presently preferred embodiments thereof, I claim:

1. A system for communicating at an event in a stadium, including (a) a plurality of articles each to be carried on the person and emanate electromagnetic waves of at least one visible wavelength from the article;

(b) means for providing at least some of the individuals attending the event with at least one of the articles;

(c) means for directing each individual with one of the articles to a selected staging area in the stadium to form a selected grouping such that the (i) articles, (ii) electromagnetic waves emanating from the articles, and (iii) grouping, are visible to others in the stadium; and, (d) means external of each individual for, when the individuals with the articles are in the selected grouping in the selected area in the stadium, altering airborne physical components contacting the articles such that the wavelength of electromagnetic waves emanating from each of the articles is changed (i) to a selected different visible electromagnetic wavelength, and (ii) to produce, for others in the stadium viewing the grouping, at least one selected visual image related to the event and including the different visible electromagnetic wavelength from each article.

2. A method for communicating at an event in a stadium, including the steps of (a) providing a plurality of articles each to be carried on the person and emanating electromagnetic waves of at least one visible wavelength from the article;

(b) providing at least some of the individuals attending the event with at least one of the articles;

(c) directing each individual with one of the articles to a selected staging area in the stadium to form a selected grouping such that the (i) articles, (ii) electromagnetic waves emanating from the articles, and (iii) grouping, are visible to others in the stadium; and, (d) when the individuals with the articles are in the selected grouping in the selected area in the stadium, altering airborne physical components contacting the articles such that the wavelength of electromagnetic waves emanating from each of the articles is changed (i) to a selected different visible electromagnetic wavelength, and (ii) to produce, for others in the stadium viewing the grouping, at least one selected visual image related to the event and including the different visible electromagnetic wavelength from each article.

* * * * *